United States Patent [19]

Takimoto

[11] 4,100,640

[45] Jul. 18, 1978

[54] BINDING MACHINE

[75] Inventor: Yasukatsu Takimoto, Sakai, Japan

[73] Assignee: Nakabayashi Kabushiki Kaisha, Osaka, Japan

[21] Appl. No.: 823,878

[22] Filed: Aug. 11, 1977

[30] Foreign Application Priority Data

Aug. 11, 1976 [JP] Japan ..... 51-96559

[51] Int. Cl.[2] ..... B42C 19/00

[52] U.S. Cl. ..... 11/1 R; 281/21 R

[58] Field of Search ..... 11/1 R, 1 MB, 1 A, 1 B, 11/1 C, 1 D; 281/21 R

[56] References Cited

U.S. PATENT DOCUMENTS

| | | | |
|---|---|---|---|
| 1,652,724 | 12/1927 | McBee | 11/1 MB |
| 3,452,376 | 7/1969 | Ito | 11/1 R |
| 3,756,625 | 9/1973 | Abilgaard et al. | 11/1 R X |
| 3,849,816 | 11/1974 | Countryman | 11/1 A |

*Primary Examiner*—Frank T. Yost

*Attorney, Agent, or Firm*—Browdy and Neimark

[57] ABSTRACT

Disclosed is a binding machine for binding papers such as chits, documents and the like by means of a binding cord which is formed simultaneously with the binding operation from a plastic tube, so that the troublesome work of preparing the binding cord and inserting it into the binding bore can be dispensed with. The binding machine has means for forming a binding bore through stacked papers to be bound, means for feeding the plastic tube as the material for the binding cord by a length corresponding to the height or thickness of the stacked paper, and adapted to sever the fed plastic tube during the upward movement of the drill after the boring, and means for inserting the severed plastic tube and heating the both ends of the severed plastic tube under application of a pressure to form these ends into respective flanges, thereby to complete the binding. These means are all installed unitarily to render the machine compact and easy to operate. A rapid and easy binding can be made, even by those who are not skilled in operation of the machine, ensuring a good appearance and durability of the bound papers, without substantially damaging the papers.

5 Claims, 14 Drawing Figures

347
344
34
24
243
465
242
344
463
464
244
245
346
462
464
324
345
323
345
32
466
342
343
32

BINDING MACHINE

FIELD OF THE INVENTION

The present invention relates to a binding machine adapted for use in binding papers and, more particularly, to a binding machine capable of binding papers such as chits, documents, printed matters and the like stacked to a predetermined height, in an attractive fashion, easily, promptly and economically, by means of staples formed at the time of the binding, without previously preparing the staples.

BACKGROUND OF THE INVENTION

Conventionally, various binding methods have been proposed and used for binding papers, such as by means of staplers, cords, yarns or wires.

However, the binding by staplers has been found inconvenient in that it is not suitable for binding a stack of papers of a large height, because of the limited size and shape of the staplers. In addition, the staplers are apt to get rusty, and the papers are likely to be damaged.

In the binding method using yarns or cords, a considerably long time is required for the binding work even by skilled hands. At the same time, the papers are likely to be torn at the binding bores, causing a fear of dropping and losing of documents.

The binding by means of wires has been unacceptable in that the wires are apt to get rusty, and the papers are likely to be spoiled and damaged, as is the case of the staplers.

The binding of papers on a large scale can be performed by a sewing press. However, this method requires highly skilled hands and, therefore, can be adopted only in binderies.

To overcome these disadvantages, a method has been proposed in the specification of U.S. Pat. No. 3,452,376 which employs binding cord made of a plastic and having a retaining enlarged portion. This method consists in preparing the binding cord, forming a binding bore through the papers, inserting the narrower end of the cord until the enlarged retaining portion comes in contact with the outermost paper, adjusting the length of the cord emerging from the filing bore and melting the cord at its portion emerging from the bore, by means of a hot press, to form another retaining enlarged portion, thereby to bind the papers. This method has advantages in that the file can have a good appearance. In addition, thanks to the flexible nature of the plastic binding cords, the bound papers can be opened widely, so that one can read letters located near the inner ends of the file which can hardly be read in the papers bound by the conventional binding methods. However, this improved binding method also has drawbacks in that it requires troublesome steps of preparing the binding cords having an enlarged portion and then inserting them into the binding bores formed in the papers, which hinders the continuous binding work.

SUMMARY OF THE INVENTION

It is therefore an object of the invention to provide a binding machine adapted for carrying out a novel binding method which can overcome the above described problems of the prior art.

It is another object of the invention to provide a binding machine capable of binding papers stacked to a predetermined height, easily and promptly, without necessitating skill.

It is still another object of the invention to provide a binding machine capable of providing a durable file of papers having an attractive appearance, avoiding damages on the papers.

It is a further object of the invention to provide a binding machine capable of providing a file of papers which can be opened widely, so as to enable one to read letters located close to the inner edges of the papers.

It is a still further object of the invention to provide a binding machine capable of binding papers by means of binding cords which are formed simultaneously with the binding, without previously preparing the cords.

It is a still further object of the invention to provide a binding machine comprising means for forming binding bores through the stacked papers, means for supplying tubes of plastic for forming binding cords and means for forming the binding cords from said tubes and binding the papers, which means are unitarily combined with one another to render the machine as a whole compact.

These and other objects, as well as advantageous features of the invention will become clear from the following description of the preferred embodiments taken in conjunction with the attached drawings in which:

DESCRIPTION OF THE PREFERRED EMBODIMENTS

Figure 1:
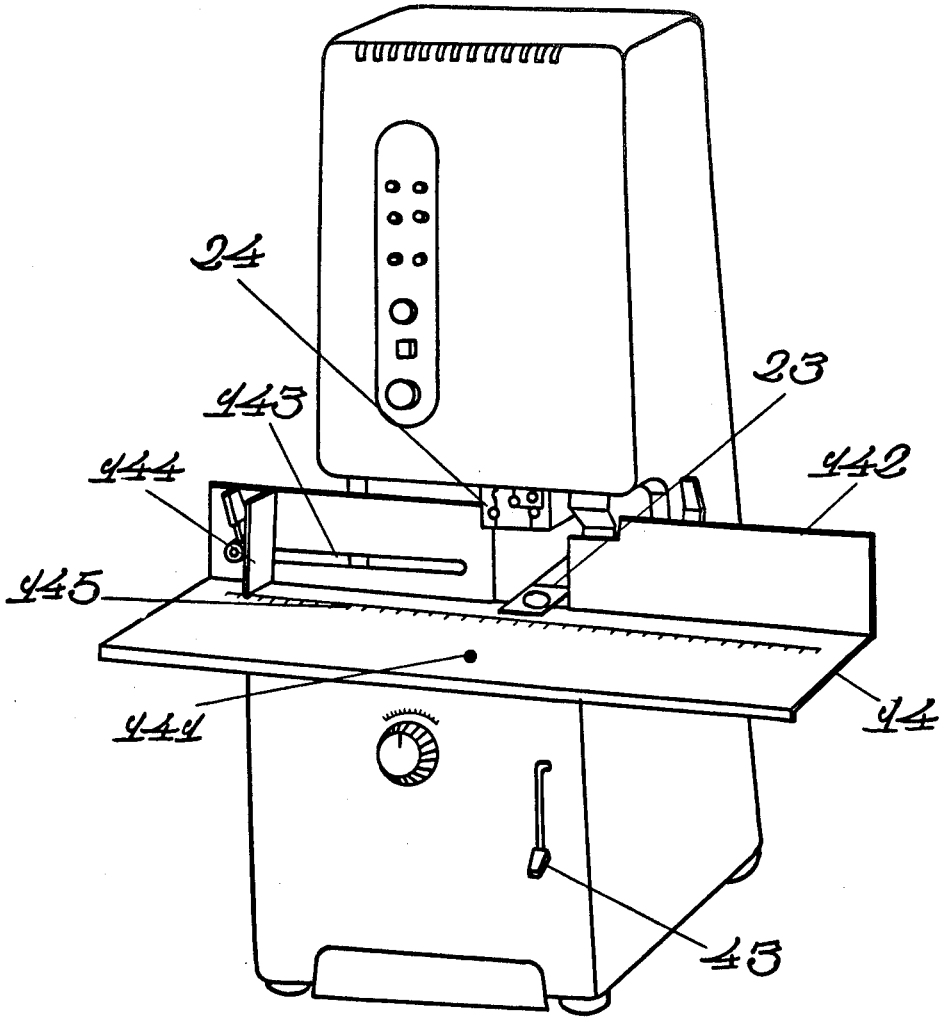
FIG. 1 is a perspective view of a binding machine as a whole, in accordance with the present invention.
Figure 2:
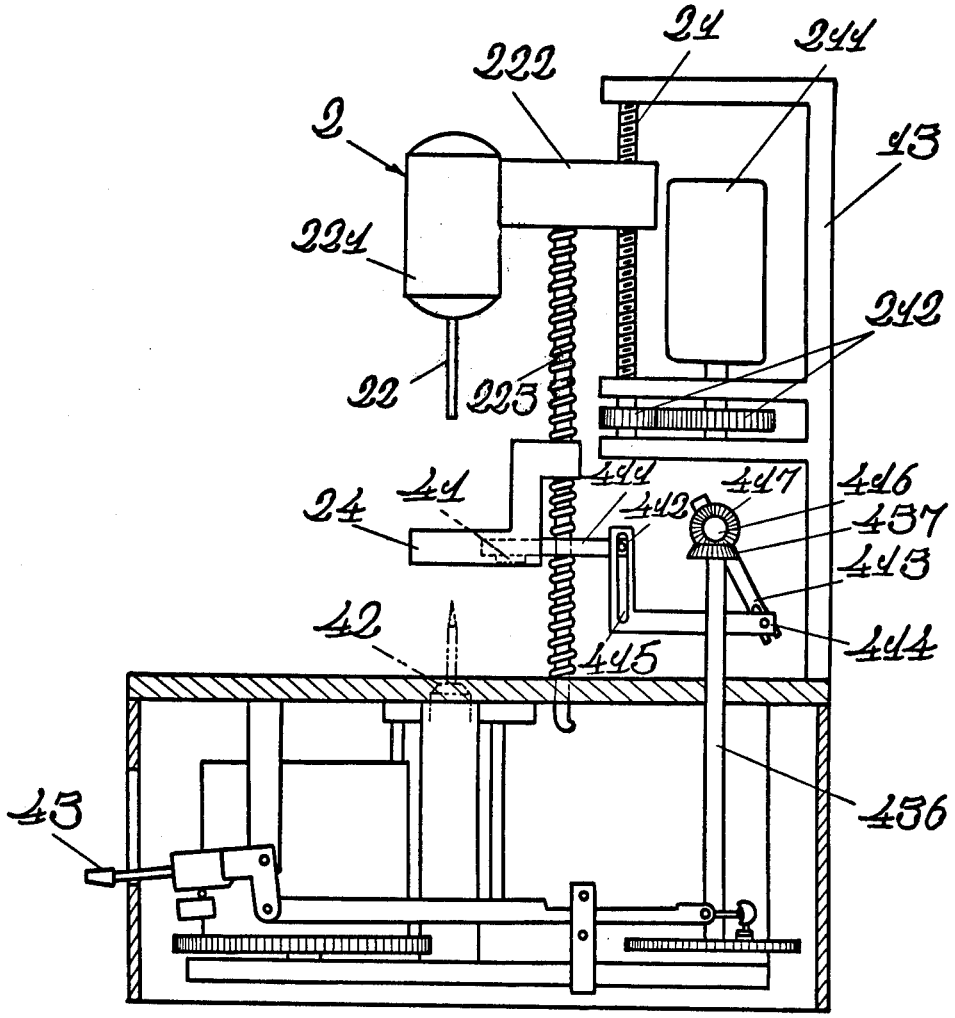
FIG. 2 is a sectional side elevational view of an essential part of the binding machine of FIG. 1.
Figure 3:
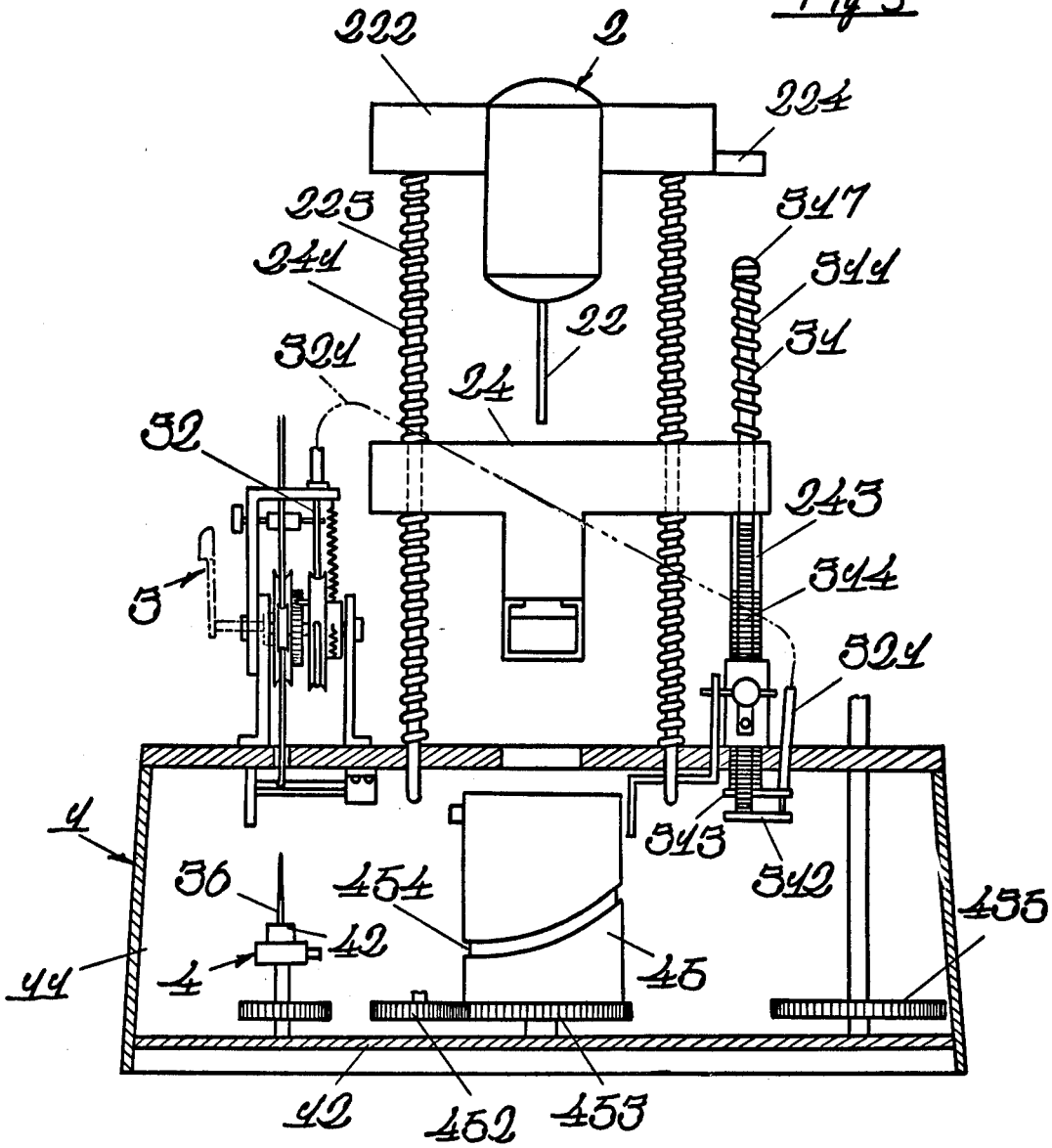
FIG. 3 is a sectional front elevational view of the essential part.

As will be seen from FIGS. 1 to 3, the binding machine of the invention is equipped with means 2 for forming binding bores through stacked papers to be bound, means 3 for supplying a predetermined length of plastic tubes which are to be formed into the binding cords and means 4 for forming the binding cords from the supplied plastic tubes, which are mounted on a base 1.

The base has an internal cavity 11 which is closed by a bed plate 12 secured to the bottom of the base 1, and suitably supports respective means at their appropriate portions. A frame 13 fixed to the rear wall of the base 1 at an upper portion of the latter is adapted to carry the means 2 for forming the binding bores and so on.

A guide plate 14 for limiting the position of the papers in accordance with the size thereof is detachably secured to the front wall of the base 1 at an upper portion of the latter, by means of screws 141. The guide plate 14 carries a true-up plate 142 for truing up and supporting papers, extending upright therefrom. A side guide plate 144 is secured to the true-up plate 142. The side guide plate 144 has a portion slidably received by an elongated bore 143 formed in the true-up plate, so that it can be moved along the elongated bore in the lateral direction, so as to be fixed at any desired position. The guide has a scale 145.

The means 2 for forming the binding bores through the papers has an operating screw rod 21 rotatably secured to the frame 13 carried by the base 1. A supporting plate 222 for supporting a drill motor 221 for actuating a drill 22 is screwed around the operating rod 21. Namely, the the supporting plate 222 for the drill motor 221 is adapted to be raised and lowered in accordance with the rotation of the screw rod 21, so as to form the binding bore in the papers stacked on the base 1, by means of the drill 22.

The screw rod 21 is adapted to be reversibly rotated by means of a reversible motor 211, through gears 212, 212. The reversing of the motor 211 is performed under a control of a limit switch. More specifically, the motor 211 is adapted to be reversed when the drill has driven deep enough to complete the boring, and when the drill 22 or the associated members comes to collide against something to cause an extraordinary torque on the drill 22 and its driving system. For instance, the switching means for reversing the motor when the boring is completed may have the following construction. A limit switch is adjustably mounted on the frame 13 of the base 1, for limiting the upper and the lower ends of the stroke of the drill 22. The arrangement is such that the supporting plate 222 for the drill motor 221 or the like comes into contact with the limit switch to depress the latter, when the drill 22 is lowered deep enough to complete the boring. The limit switch is then actuated to cause the reversing of the motor 221.

Figure 4:
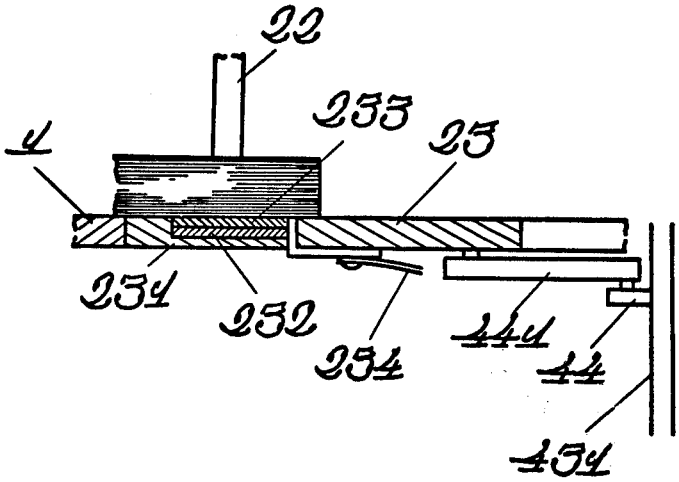
FIG. 4 is a sectional side elevational view of an underlay plate confronted by a drill.

Alternatively, as shown in FIG. 4, an underlay plate 23 is mounted on the upper face of the base 1, so as to confront the drill 22. The underlay plate 23 has a recess 231 in its surface, in which is embedded an electrically conductive plate 232 made of a material having a good electrical conductivity, e.g. aluminum, carbon, rubber or a plastic in which grains of carbon or aluminum are dispersed. The conductive plate 232 is covered by a thin insulating plate 233 having a good elasticity, made of an insulating material such as a plastic or the like.

The conductive plate 232 is electrically connected to the limit switch for causing the reversing the motor 211, by means of wiring 234. Thus, as the drill 22 is driven deep enough to complete the boring, the end of the drill having passed through the elastic insulating plate 233 comes into contact with the conductive plate 232, so as to allow a weak electric current through a circuit including the drill 22 and the wiring 234, so as to actuate the limit switch to cause the reversing of the motor 211.

Consequently, the screw rod 21 is reversed to lift the assembly including the drill upwardly.

This automatic reversing of the motor can ensure a safe and perfect boring of the papers, without causing a substantial danger on the operator.

Figure 5:
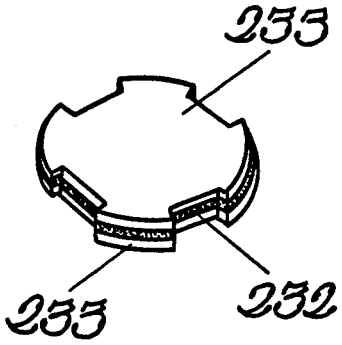
FIG. 5 is a perspective view of a perspective view of a conductive plate provided on the underlay plate.

It is possible to make the position of the elastic insulating plate 233 and the conductive plate 232 or of the insulating plate 233 solely, adjustable on the recessed portion 231, or these plates can be secured to the base 1 detachably. It is still possible to adhere the insulating plates 233, 233 to both sides of the conductive plate 232, as shown in FIG. 5.

Figure 6:
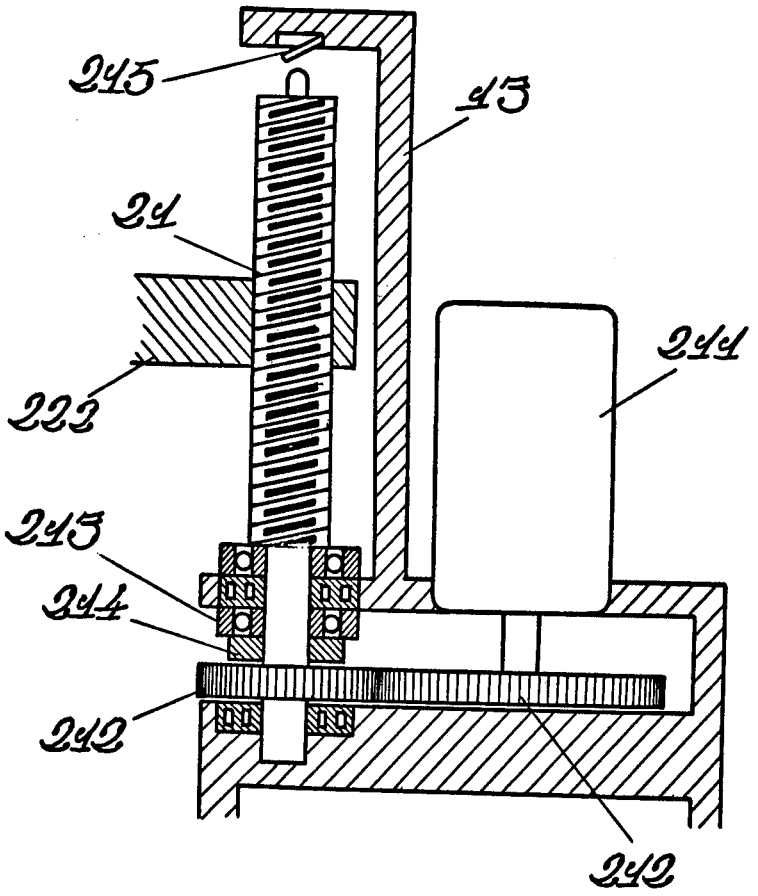
FIG. 6 is an illustration of a lifting safety device of a drill supporting plate.

FIG. 6 shows a safety device for reversing the motor when the drill 22 or its associated members are encountered by something during the downward movement. More specifically, referring FIG. 6, an anti-pressure rubber ring 214 is provided between the lower portion of the bearing 213 of the screw rod 21 and the gear 212, while a reversing limit switch 215 is secured to the lower face of the frame 13, so as to oppose to the upper end of the screw rod 212. In operation, the supporting plate 222 for the drill motor 221, screwed to the screw rod 21, as the motor 211 is energized it rotates the screw rod 21. Supposing here that the drill 22 or its associated members such as the drill motor 211 or the supporting plate 222 comes into contact with something unexpected, the drill 22 and the associated member as a whole stops the downward movement. Since the motor goes on its operation to drive the screw rod 21, the screw rod 21 comes to move upwardly, while the drill 22 and its associated members are kept stationary.

Finally, the screw rod 21 goes up to a position where its upper end comes to depress the reversing limit switch 215 to cause the reversing of the motor.

Consequently, the screw rod 21 is reversed and lowered due to the thrust force caused by the reversing and the elasticity of the anti-pressure rubber ring 214, so that the drill 22 and its associated members contacting the unexpected object are moved upwardly, clearing the latter. It will be seen that this device is effective to protect the drill 22 and its associated members from being damaged.

Numeral 24 denotes a pressing member adapted to press the papers stacked on the base 1 and guided by the guide plate 14, thereby to fix the papers at the right position. The pressing member 24 is slidably fitted around a pair of vertical guide rods 223, 223 provided at respective sides of the suppor plate 222 for the motor 221 and extending downwardly into the cavity 11 in the base 1. The pressing member 24 is resiliently held by opposing upper and lower springs 241, 241, wound around each vertical guide rod 223. Consequently, the pressing member 24 is allowed to move downwardly along with the support plate 222 for the motor 221, as the latter is lowered. A rack 242 is provided unitarily with the pressing member 24. The rack 24 is formed on a -shaped retaining rod 243, and is extended to reach the cavity 11 of the base 1.

Figure 7:
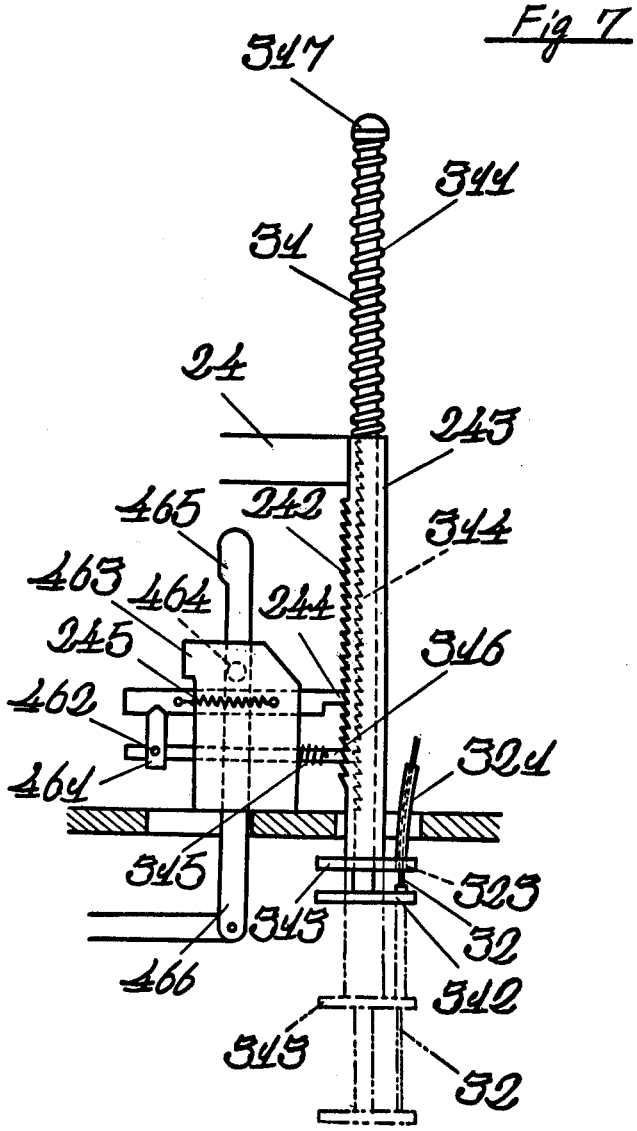
FIG. 7 is an illustration of a rod of a pressing piece for fixing the papers to be bound, and a side elevational view of an essential part, showing a starting rod for starting means for supplying plastic tubes which are to be formed into the binding cords.

An engaging piece denoted by 244 in FIG. 7 is biased by a spring 245 into engagement with the teeth of the rack 242, so as to prevent the lowered pressing member 24 from moving upward unintentionally, thereby to securely hold the papers stacked on the base, preparing for the boring.

Turning now to the means 3 for supplying the plastic tube for forming the binding cord by a predetermined length, referring to FIG. 7, a starting rod 31 for starting the supply has a portion upwardly projecting from the retaining rod 243, around which is provided a spring 311 to support the starting rod 31. The starting rod 31 also has at its lower end an engaging piece 312. The engaging piece 312 is so positioned as to oppose the engaging portion 313 secured to the lower end of the retaining rod 243 having the rack 242. The arrangement is such that the engaging portion 313 of the retaining rod 243 comes into contact with the engaging piece 312, so as to lower the starting rod 31, as the retaining rod 243 is lowered.

The starting rod 31 is provided with a rack 314 which meshes with an engaging member 316, so as to prevent the lowered starting rod from unintentionally coming up. A pressing portion 317 secured to the upper end of the starting rod 31 is positioned to confront an actuating member 224 projected from the support plate 222 of the drill motor 221, with a specific gap left therebetween.

The specific distance is almost equal to the distance between the extreme end of the drill 22 in the normal position and the lower face of the pressing member 24. More specifically, the specific gap is slightly smaller than the above stated distance, i.e. by a length corresponding to the length of the flanges which are to be formed at both ends of the binding cord by melting the ends of the plastic tube.

The pressing portion 317 is constituted by a cap nut or the like, so that its position may be adjustable. More specifically, as the pressing member 24 is lowered, the starting rod 31 is lowered along with the retaining rod 243 having the rack 242. When the pressing member 24 comes to press the papers stacked on the base 1 to stop the further downward movement, the retaining rod 243 having the rack 242 and, accordingly, the starting rod 31 are stopped. Meanwhile, the support plate 222 for the drill motor 221 goes on its downward movement, due to the continuous rotation of the screw rod 21.

The actuating member 224 projecting from the support plate 222 comes into contact with the pressing portion 317 of the starting rod 31, immediately before the end of the drill 22 driven by the drill motor 221 reaches the stacked papers pressed by the pressing member 24. Thus, the pressing portion 317 of the starting rod 31 is depressed during the downward movement of the drill 22, until the latter completes the boring through the stacked papers, so that the starting rod slides downwardly, within the retaining rod 243 provided with the rack 242. It is clear that the distance travelled by the starting rod is substantially equal to the height of the stacked paper and, in a more strict sense, slightly longer.

A towing or pulling rope denoted by numeral 32 has an outer sleeve or sheath 321. The base portion of this pulling rope 32 is fixed to a rope taking-up roller 322 and is adapted to be taken up by the latter. The leading end of the rope 32 is fixedly attached to the lower engaging piece 312 of the starting rod 31, passing through a guide bore 323 formed in the lower engaging portion 313. Therefore, since the engaging piece 312 moves downward away from the engaging portion 313 of the retaining rod 243, when the starting rod slides downward at the inside of the retaining rod 243, the pulling rope 32 secured to the engaging piece 312 is extracted by a length equal to the downward stroke of the engaging piece 312.

Figure 8:
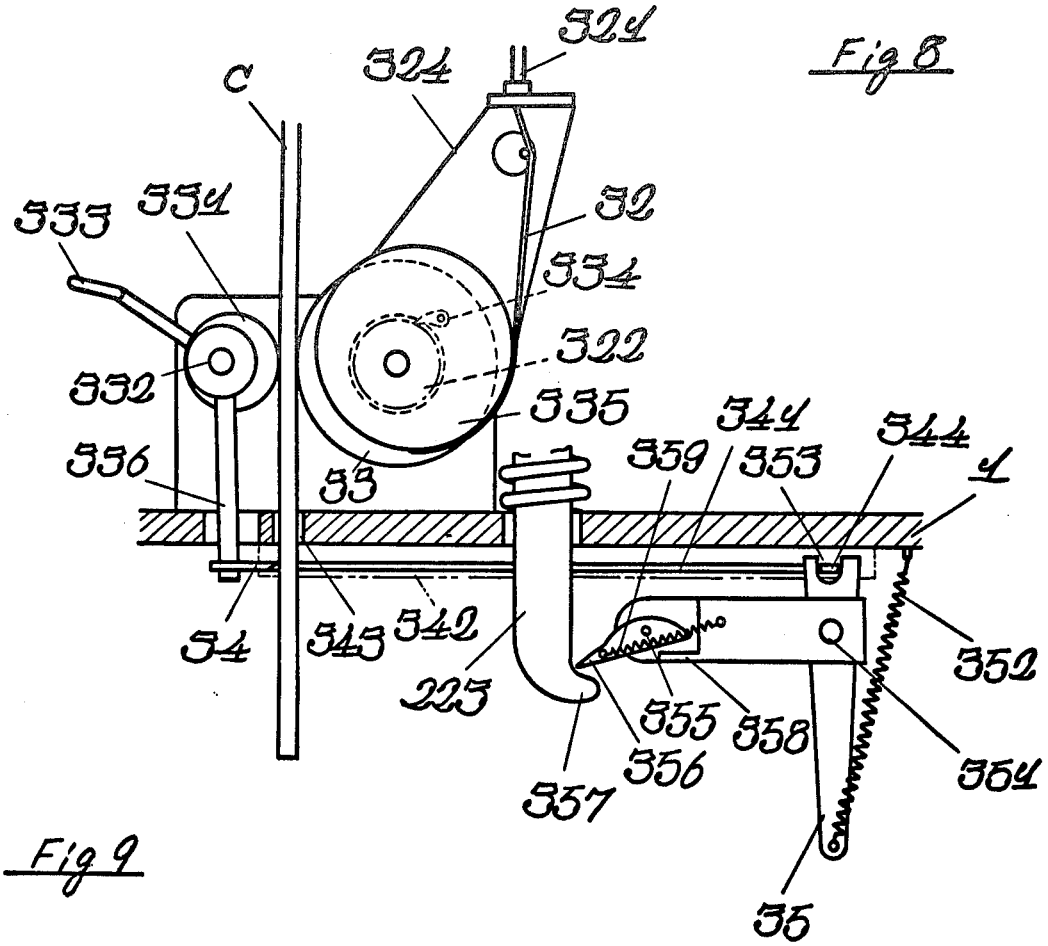
FIG. 8 is a side elevational view of a supplying portion of means for supplying plastic tubes which are to be formed into binding cords.
Figure 9:
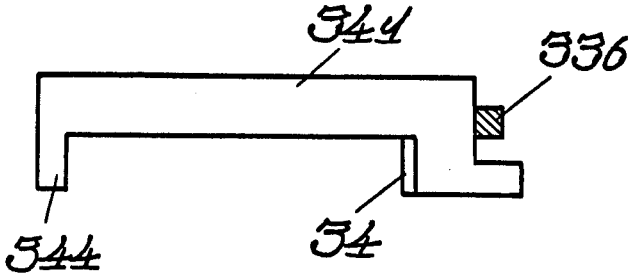
FIG. 9 is a plan view of a cutting edge.

As will be seen from FIGS. 3 and 8, the base portion of the sheath or the outer sleeve 321 of the pulling rope 32 is fixedly secured to a frame 324 for supporting the rope taking-up roller 322, while the leading end thereof is secured to the lower engaging portion 313 of the retaining rod 243. The rope taking-up roller 322 is normally biased in one rotational direction so as to take up the rope 32, by means of a spring 325.

A feeding roller 33 for feeding the plastic tube is loosely mounted on the shaft 326, for free rotation thereon, and is opposed by a friction roller 331. The friction roller 331 is supported by an eccentric shaft 332, so that it may be moved to and from the feed roller 33, as the eccentric shaft 332 is rotated by means of a lever 333. Namely, for feeding the plastic tube into the gap between the feed roller 33 and the friction roller 331, the latter is moved away from the feed roller 31, so as to facilitate the insertion of the plastic tube into the gap. To the contrary, for feeding the plastic tube in interlocking with other actuating mechanisms, the friction roller 331 is moved toward the feed roller 33, so as to cramp the plastic tube therebetween. Then, the cramped plastic tube can be fed, as the feed roller 33 is rotated. The rotation of the feed roller 33 is caused upon engagement of a pawl 334 on the rope taking-up roller 322 with a toothed wheel 335 which is unitarily secured to the feed roller 33 and adapted to rotate ony in one direction.

Namely, as the rope taking-up roller 322 rotates, the pawl 334 unitary with the roller 322 is moved to rotate the meshing toothed wheel 335, so as to rotate the feed roller 33, which is unitary with the toothed wheel 335, in synchronization with the rope taking-up roller 322. Therefore, if the feed roller is designed to have the same size as the rope taking-up roller, the plastic tube is fed by a length equal to that by which the pulling rope is extracted.

A cutting edge denoted by numeral 34 has a handle portion 341 slidably supported by a supporting frame 342 provided at the inside of the base 1, and is adapted to be reciprocated across a feed opening 343 formed in the base 1 confronting the tube outlet defined by the opposing feed roller 33 and the friction roller 33. To explain in more detail, the cutting edge 34 has a retaining tab 344 formed at the end of the handle portion 341. The retaining tab 344 is received by a forked retaining portion 353 formed at the upper portion of an actuating member 35. The actuating member 35 is rotationally supported at its mid portion by a shaft 351, and is biased in one rotational direction by means of a spring 352 connected to the lower end thereof. Consequently, the cutting edge 34 is so biased as to be always located at one side of the feed port 343.

On the other hand, the rotary shaft 351 of the actuating member 35 unitarily carries an arm 354. The end of the arm 354 is positioned close to the base portion of one of the vertical guide rods 223 attached to the support plate 222 for the drill motor 221. The arm 354 carries at its end a swingable lever 356 pivoted as denoted by 355 for free rotation. The swingable lever 356 is positioned to oppose the vertical guide rod 223, so as to be contacted by a projection formed at the lower end of the vertical guide rod 223, as the latter moves up and down. A stopper 358 is formed beneath the base portion of the swingable lever 356. A spring 359 is provided to normally bias the swingable lever 356 so as to put the base portion of the latter into contact with the stopper 358. When the vertical guide rod 223 is lowered along with the drill 22 for forming the binding bores through the stacked papers, the lower edge of the projection 357 comes into engagement with the end of the swingable lever 356. However, this does not hinder the further downward movement of the vertical guide rod 223, because the swingable lever 356 is swung downwardly, against the biasing force of the spring 359. However, when the vertical guide rod 223 is moved upwardly along with the drill 22, after the completion of the boring, the upper edge of the projection 357 provided at the lower end of the vertical guide rod 223 comes to abut the swingable lever 356, so as to press the base portion of the latter onto the stopper 358. Consequently, the arm 354 is moved upwardly, along with the arm 354.

The upward movement of the end portion of the arm 354 causes a rotation of the rotary shaft 351 carrying the actuating member 35, so that the retaining tab 344 of the cutting edge 34, which has been received by the forked retaining portion 353 of the actuating member 35, is retracted. Accordingly, the cutting edge 34 is moved across the feed port 343 to the other side of the latter, thereby to sever the portion of the plastic tube emerging from the feed opening 343.

A further upward movement of the guide rod 223 allows the projection 357 to clear the swingable lever 356, so that the actuating member 35 and the arm 354 are returned to the original positions. Accordingly, the cutting edge 34 is also returned to the original position.

To the end of the handle portion 341 of the cutting edge 341, is connected a connecting rod 336 interlocking the lever 333 for adjusting the position of the friction roller 331 relatively to the feed roller 33. The arrangement is such that the connecting rod 336 is actuated at an instant when the lever 333 is operated to move the friction wheel 331 away from the feed roller 33, so as to move the cutting edge 34 ahead to the position of the feed opening 343, thereby to close the feed opening 343. Consequently, the position of the newly fed portion of the plastic tube is regulated, at the time of the feed.

The severed plastic tube drops and fits around a receiving needle 36 previously stationed beneath the feed opening. Preferably, the lower end portion of the plastic tube is fitted to the upper portion of the receiving needle 36, in advance to the severing.

Referring now to the means 4 for forming the binding cord, the plastic tube is formed into the binding cord by means of an upper heating mold 41 and a lower heating mold 42 adapted to heat and press the upper and the lower ends of the severed plastic tube, respectively, so as to melt and deform the ends into flanges.

As will be seen from FIG. 2, the upper heating mold 41 is mounted for free sliding movement with respect to the inner lower surface of the pressing member 24, so that it may be retracted so as not to hinder the lowering of the drill 22, during the drilling, and moved ahead to the position of the binding bore formed by the drill 22, when forming the binding cord from the plastic tube.

More specifically, the upper heating mold 41 is supported by a sliding rod 411 provided at its end with a pin 412. The pin 412 is received by a guiding elongated bore 415 formed in the upright portion of an L-shaped connecting rod 414 adapted to be moved back and forth by a rotary arm 413. Namely, rotary arm 413 is adapted to be rotated around a rotary shaft 416, so as to move the L-shaped connecting rod 414 back and forth. Consequently, the sliding rod 411 is moved back and forth, thereby to to slidingly move the upper heating mold 41.

The rotation of the rotary shaft is caused by an actuation of an actuating lever 43. Namely, the actuating lever 43 is supported at its base portion rotatably by means of a shaft 431, and is connected to a bent arm 432 which in turn is connected to a rearwardly extending connecting rod 433. The connecting rod 433 is connected at its base portion to the upper side of a sprocket 435 through an universal joint 434. The sprocket 435 is supported by a rotary shaft 436 which extends upwardly from the base 1. A bevel gear 437 provided at the upper portion of the rotary shaft 436 is adapted for engagement with a bevel gear 437 provided on the rotary shaft 416 of the rotary arm 413.

Therefore, as the actuating lever 43 is rotated in a vertical plane around the shaft 431, the bent arm 432 causes the connecting rod 433 to slide back and forth, so as to pull and push the one side of the sprocket 435 provided at the base portion of the connecting rod 433, thereby to cause a rotation of the rotary shaft 436.

The rotation of the rotary shaft 436 is transmitted to the rotary arm 413, through the bevel gears 437 and 417, and then through the rotary shaft 416.

The rotary shaft 436 is provided with an arm 44 to which is pivoted a base portion of a connecting rod 441 which is connected to the underlay plate 23. The arrangement is such that the arm 44 is rotated, as the rotary shaft 436 is rotated, so as to cause the connecting rod 441 to move back and forth. Consequently, the connecting rod 441 is moved back and forth to open and close a port 15 of the base 1.

Thus, contrarily to the upper heating mold 41 which slides back and forth within the pressing member 24, the underlay plate 23 is moved ahead to lay under the drill, when the latter is lowered for the boring purpose, and retracted to allow the port 15 open, when the plastic tube is inserted and formed into the binding cord.

The lower heating mold 42 is supported by a rotary supporting plate 421, so as to reciprocatorily rotate between the supplying position of the plastic tube and the position of the port 15 where the binding bore through the stacked papers is formed.

The aforementioned receiving needle 36 for receiving the plastic tube severed in a predetermined length is provided at the center of the lower heating mold 42.

Figure 10:
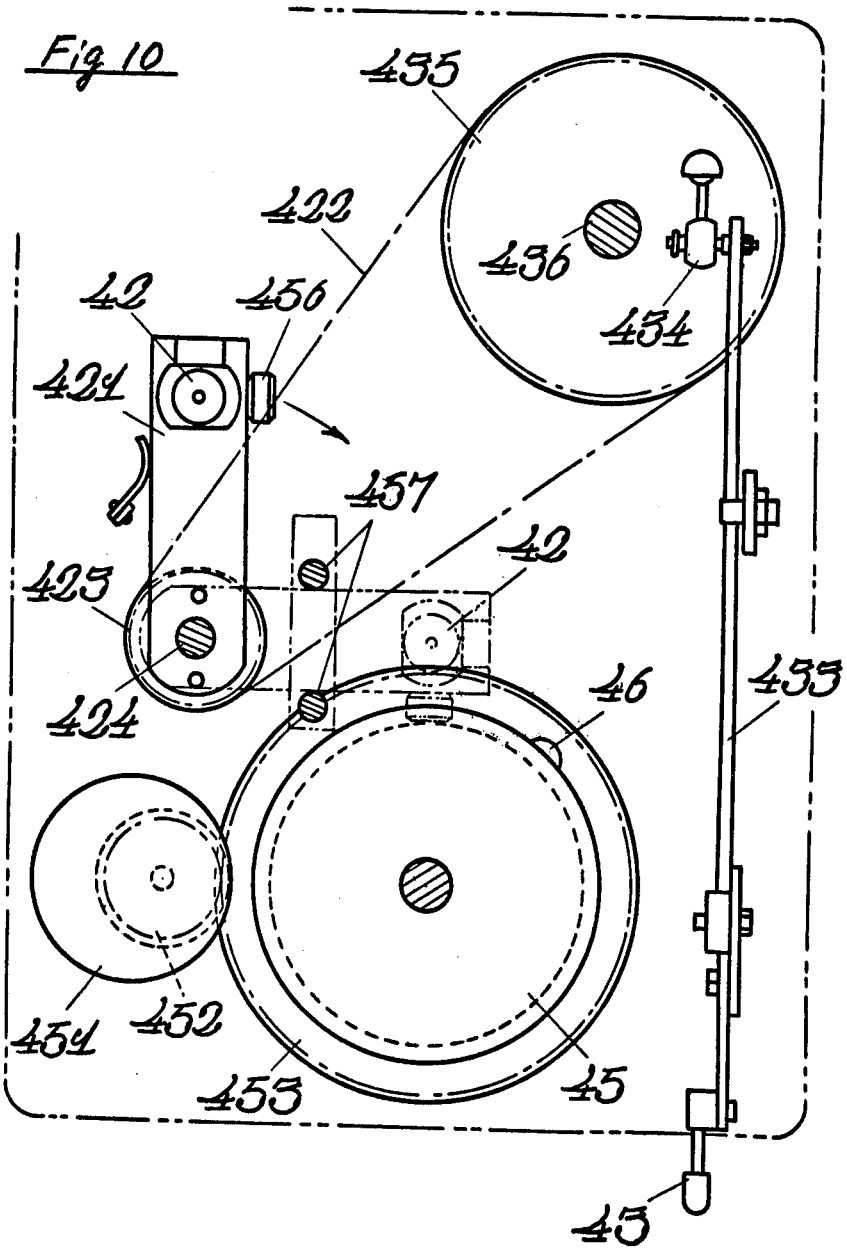
FIG. 10 is a sectional plan view of the essential
Figure 11:
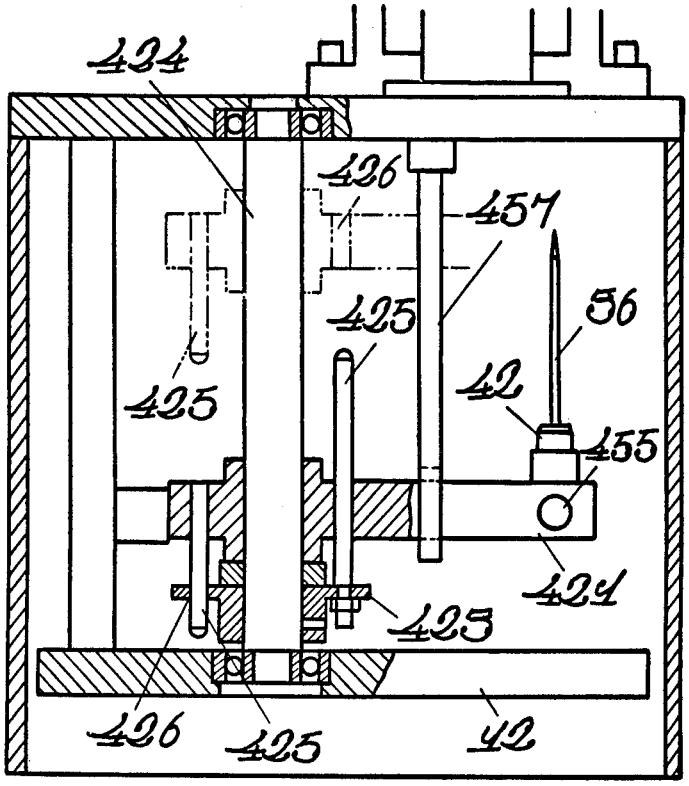
FIG. 11 is a sectional front elevational view of a rotary support plate in support of a lower heating mold.

As will be seen from FIG. 10, the base portion of the rotary supporting plate 421 is axially slidably mounted on a rotary shaft 424 of a sprocket 423 which is operably connected to the aforementioned sprocket 435 through a chain 422. This slidable mounting of the rotary supporting plate 421 on the rotary shaft 424 may be made through a key or may be made, as is the case of the embodiment as shown in FIG. 11, by means of a plurality of bores 426 and rods 425 slidably received by the bores, provided on the sprocket 423 and the rotary supporting plate 421, so that the position of the rotary supporting plate 421 relative to the rotary shaft 424 may be correctly regulated.

Figure 12:
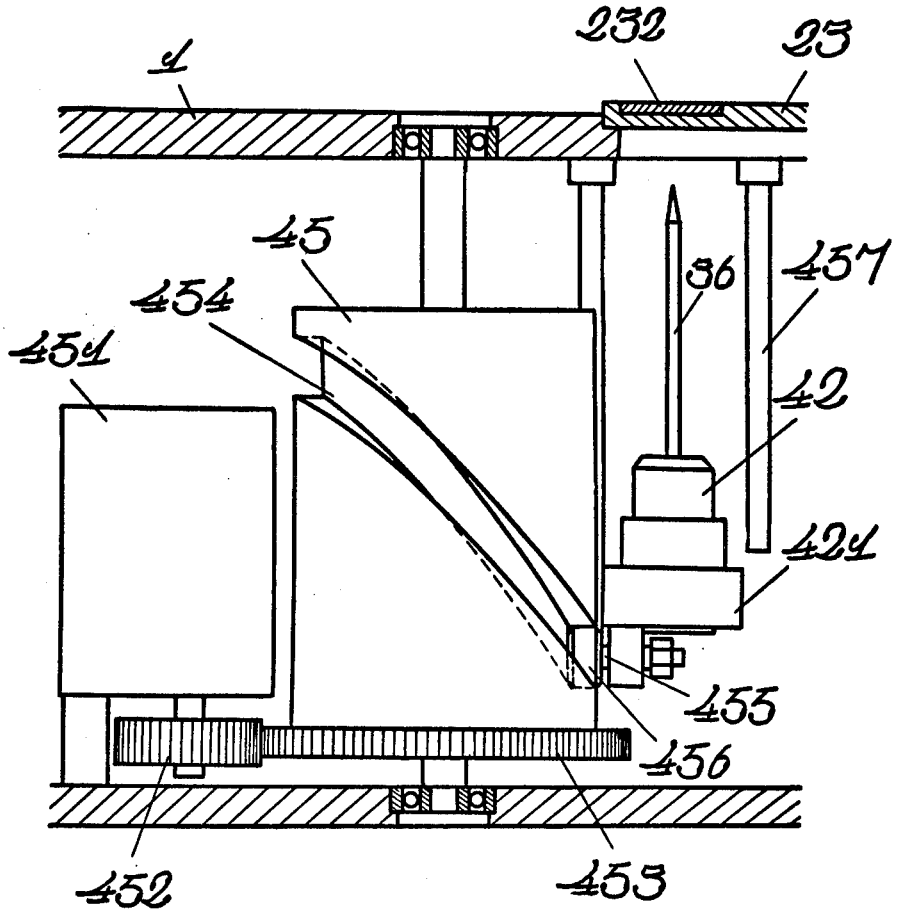
FIG. 12 is a front elevational view of an essential part, showing the manner in which the lower heating mold is raised and lowered.

A vertical guide sleeve denoted by 45 is adapted for guiding the up and downward movement of the lower heating mold 42 along with the rotary supporting plate 421. More specifically, as shown in FIG. 12, the vertical guide sleeve 45 is adapted to make a turn, as the rotation of the motor 451 provided on the bed plate 12 is transmitted thereto through gears 452 and 453.

The vertical guide sleeve 45 has a peripheral cam groove 454 which receives a pin 455 projecting from the rotary supporting plate 421, so that the rotary supporting plate 421, i.e. the lower heating mold 42, is lifted and lowered in accordance with the rotation of the vertical guide sleeve 45. Preferably, the pin 455 carries a roller 456 fitted thereto. Two guide rods 457 are provided within the base 1 to extend vertically, so as to limit the both ends of the rotary supporting plate 421 which moves up and down.

Consequently, after severing the plastic tube by a suitable length, subsequent to the boring through the stacked papers, and then supplying the severed plastic tube to the receiving needle 36 provided at the center of the lower heating mold 42, the connecting rod 433 is pulled to rotate the sprocket 435, as the actuating lever 43 is operated.

Consequently, the rotary shaft 436 of the sprocket 435 is rotated to cause the rotation of the bevel gear 437 and the arm 44. Then, the bevel gear drives the rotary arm 413, through the bevel gear 417, so as to push the L-shaped connecting rod 414 ahead to advance the upper heating mold 41, along with the sliding rod 411 to the predetermined position above the pressing member 24, i.e. to the position just above the binding bore formed in the stacked papers. At the same time, the arm 44 acts to retract, through the connecting rod 441, the underlay plate 23, thereby to open the port 15 of the base 1.

Meanwhile, the sprocket 423 is rotated in accordance with the rotation of the sprocket 435, so that the rotary supporting plate 421 supported by the shaft 424 of the sprocket 423 is rotated, so as to position the lower heating mold 42, which carries at its center the receiving pin 36 to which the severed plastic tube is fitted, to confront the lower opening of the binding bore formed through the stacked papers. Then, as the rotary supporting plate 421 for sypporting the lower heating mold 42 is rotated, the pin 455 of the rotary supporting plate 421 is received by the peripheral cam groove 454 of the vertical guide sleeve 45, and the motor 451 is started by, for example, an actuation of a limit switch or the like, to cause the rotation of the vertical guide sleeve 45. Therefore, the pin 455 is at first moved upwardly and then lowered to the starting position, following the rotating peripheral cam groove 454.

Namely, the rotary supporting plate 421 provided with the pin 455 is at first moved upwardly along the rotary shaft 424, being accompanied by the lower heating mold 42 supported by the plate 421, so as to insert the plastic tube carried by the receiving needle 36 into the binding bore formed through the stacked paper from the lower end of the latter, until the upper end of the tube come into contact with the upper heating mold 41, and to press the tube onto the latter 41.

Figure 14:
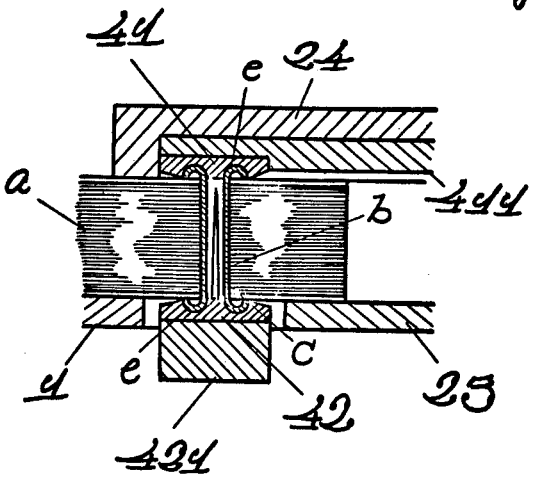
FIG. 14 is a sectional side elevational view of an essential part, showing the manner in which the binding cords are formed.

Therefore, as shown in FIG. 14, the upper and the lower ends of the plastic tube is melted and deformed to form flanges, by means of the upper and the lower heating molds, respectively. It will be seen that the plastic tube now having both end flanges can serve as a strong binding cord, to complete the binding.

The rotary supporting plate 421 carrying the lower heating mold 42 is then lowered to the original position.

An actuating member denoted by 46, provided to project from an upper portion of the vertical guide sleeve 45 is intended for returning the pressing member 24 and the starting rod 31 for the supply of the plastic tube, to the original position, after the completion of the binding. More specifically, the engaging piece 244 meshing with the rack 242 of the retaining rod 243 unitarily formed with the pressing member 24 is connected, through a connecting rod 461, to the engaging piece 316 meshing with the rack 314 of the starting rod 31. The connecting rod 461 is provided with a retaining piece 462 projecting laterally therefrom. An oscillating rod 466 provided with an upper handle portion 465 and supported by a shaft 464 of a supporting frame 463 for engaging piece is disposed to confront the retaining piece 462. The arrangement is such that as the oscillating rod 466 is rotated to press the retaining piece 462, the engaging pieces 244 and 316 are retracted, against respective springs 245,315, through the connecting rod 461, thereby to disengage these pieces from respective racks 242,314, so that the pressing member 24 and the starting rod 31 are returned to the original positions by means of the springs 241 and 311.

The rotation of the oscillating rod 466 is caused in the following manner.

Figure 13:
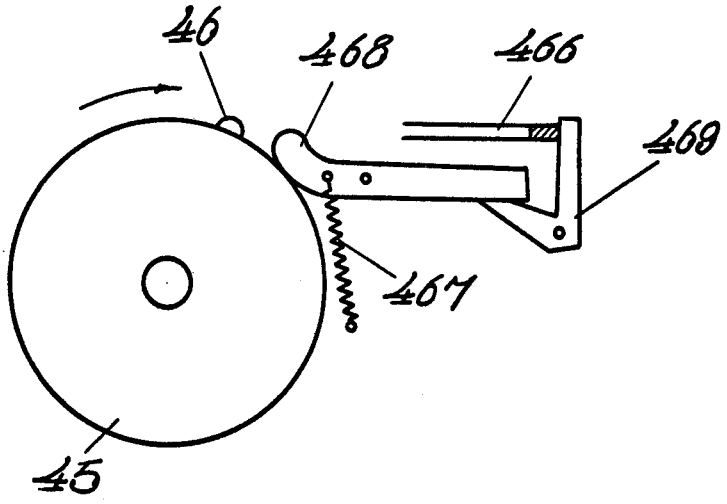
FIG. 13 is a plan view of an essential part of a resetting mechanism incorporated in the binding machine.

Namely, as shown in FIG. 13, an actuating rod 468 is always pressed at its end onto the vertical guide sleeve 45, by means of a spring 467. The actuating rod 468 is rotated, in accordance with the rotation of the vertical guide sleeve 45, by means of the actuating piece 46 provided on the latter 45. The motion of the base portion of the actuating rod 468 is then transmitted to the oscillating rod 466, through an idle rod 469 provided beneath the oscillating rod 466.

The binding machine in accordance with the invention having the above-described construction functions in the following manner.

At first, the lever 333 is rotated to clear the friction roller 331 from the feed roller 33 for feeding the plastic tube. At the same time, the cutting edge 34 is moved ahead by means of the connecting rod 336, to close the feed opening 343 by the cutting edge 34. Subsequently, a thermoplastic synthetic resinous tube C such as of nylon is inserted into the gap between feed roller 33 and the friction roller 331, so as to position the end of the tube above the cutting edge 34 now closing the feed opening 343. Subsequently, the lever 333 is returned to move the friction wheel toward the feed roller 33, so as to cramp the plastic tube C by means of both rollers 33, 331, and to return the cutting edge 34 to the original position.

Then, the papers *a* to be bound are stacked and trued up, and are put on the guide plate 14 secured to the base 1, adjusting the position where the binding bore is to be formed.

As the starting switch of the machine is depressed, the driving motor 211, as well as the drill motor 221, is started. As the driving motor 211 is started, the vertical screw rods 21 are rotated, through the gears 212,212, so as to lower the support plate 222 for the drill motor 221. The pressing member 24 is also lowered through the springs 241 and 241.

Then, the pressing member 24 reaches the upper face of the stacked papers *a* to be bound. A further downward movement of the pressing member 24 allows the latter to sufficiently press and fix the papers. Then, the lowering of the pressing member 24 is stopped, and is fixed at that position by the engagement of the rack 242 of the retaining rod 243 unitary with the pressing member, with the engaging piece 244.

Meanwhile, the supporting plate 222 is further lowered, so as to allow the drill 22 to form the binding bore *b* through the papers stacked and cramped by the pressing member 24. As the boring is completed, the end of the drill 22 comes into contact with the conductive plate 232 below the papers *a*, so as to allow a faint electric current to pass through the drill 22 and the wiring 234, to actuate the limit switch for reversing the driving motor 211. Consequently, the drill 22 is lifted up to the original position, so that the limit switch is actuated to stop the driving motor 211 and the drill motor 221.

During this process, the starting rod 31 which moves downwardly along with the retaining rod 243 of the pressing member 24 is stopped, when the downward movement of the pressing member 24 is stopped after sufficiently pressing the papers. However, the supporting plate 222 supporting the drill 22 is allowed to move further downward, so that the actuating piece 224 of the supporting plate 222 comes to depress the pressing portion 317 of the starting rod 31, immediately before the arrival of the drill end at the surface of the papers*a* to be bound, thereby to restart the downward movement of the starting rod 31. The downward movement of the starting rod 31 is continued from an instant immediately before the commencement of the boring through the papers *a* by the drill 22, until the boring is completed.

Consequently, the lower engaging piece 312 of the starting rod 31 is lowered from the engaging portion 313 of the retaining rod 243, by a length corresponding to the length of the stacked papers *a*, so as to pull the tow rope 32. The rotation of the rope taking-up roller 322 is caused, as the rope 32 is pulled, so that the feed roller 33 is also rotated to feed the plastic tube C by a length corresponding to the height or thickness of the stacked papers *a*, inwardly from the feed port 343.

Then, in accordance with the rise of the drill 22, the lower projection 357 of the vertical guide rod 223 comes to rotate the actuating member 35, through the swingable lever 356 and the arm 354, thereby to reciprocatorily move the cutting edge 34, so that the supplied plastic tube end is severed and supplied to the receiving needle 36 on the lower heating mold 42.

Then, by upwardly rotating the actuating lever 43, the connecting rod 433 is pulled forwardly, so as to rotate the rotary shaft 436 through the sprocket 435.

The rotary motion of the rotary shaft 436 is transmitted, through the bevel gears 437,417, to the arm 413, so as to cause a forward movement of the L-shaped connecting rod 414. Consequently, the upper heating mold 41 is moved ahead within the pressing member 24, to come to confront the binding bore *b* formed through the papers *a* to be bound. At the same time, the rotation of the rotary shaft 436 causes a rotation of the arm 44 which in turn causes, through the connecting rod 441, a retracting motion of the underlay plate 23, thereby to open the port 15 of the base 1. Further, the rotation of the rotary shaft 436 causes a rotation of the rotary supporting plate 421 in support of the lower heating mold 42, through the sprocket 435, chain 422 and the sprocket 423, so as to bring the lower heating mold into alignment with the binding bores *b* formed through the papers *a* to be bound, at the lower side of the bore. Meanwhile, in accordance with the movement of the lower heating mold 42, the pin 455 of the rotary supporting plate 421 comes into engagement with the cam groove 454 of the vertical guide sleeve 45. Then, as the motor 451 is started to rotate the vertical guide sleeve 45, the lower mold 42 is raised to bring the severed plastic tube C into pressurized contact with the upper heating mold 41, through the binding bore *b* formed in the papers *a* to be bound. Consequently, the the upper and the lower ends of the plastic tube C are melted by the heat delivered by respective molds 41,42, under application of a pressure, so as to form flanges e,e. The plastic tube now formed into the binding cord having the upper and the lower flanges e,e then firmly binds the stacked papers *a*.

Subsequently, the lower heating mold 42 is lowered and the pressing member 24 is returned to the original position to release the papers *a*, thereby to complete the binding process.

As will be seen from the foregoing description, according to the invention, a practical advantage is brought about that the binding is performed by the binding cord which is formed simultaneously with the binding operation, without necessitating the previous preparation of the binding cord.

In addition, the binding can be made, in accordance with the height or thickness of the stacked papers, promptly and easily, even by those who are not skilled in operating the binding machine.

Further, the papers are not damaged by the binding, and can be preserved for a long period maintaining the good appearances.

Furthermore, thanks to the unitary installation of the means for forming the binding bore through the papers to be bound, means for supplying the plastic tube as the material for the binding cord, and means for inserting the plastic tube into the binding bore and forming it into a binding cord, the machine is rendered as a whole compact and easy to handle.

What is claimed is:

1. A binding machine comprising:

means for forming a binding bore through stacked papers to be bound having a drill adapted to be raised and lowered with respect to a base of the machine for forming the binding bore, and pressing members for pressing stacked papers, supported by a support plate for said drill through a spring and adapted to be lowered accompanying said drill, said pressing member having a retaining rod for retaining the lowered position of said drill;

means for feeding plastic tube of a predetermined length adapted to be started by an actuation of a starting rod adapted to be moved as said drill is driven into said stacked papers to form said binding bore, so as to feed said plastic tube by a length substantially equal to the thickness or height of said stacked papers, said means for feeding plastic tube being further adapted to sever the fed plastic tube during the upward movement of said drill; and means for forming a binding cord adapted to bring a lower heating mold provided at its center with a receiving needle adapted to be supplied with the severed plastic tube and an upper heating mold into alignment with the binding bore formed through said stacked paper and into engagement with each other, said means for forming the binding cord being further adapted to raise said lower heating mold to insert said severed plastic tube into said binding bore until the upper end of said severed plastic tube comes to be pressed to said upper heating mold, so as to melt the upper and lower ends of said plastic tube and form these ends into respective flanges, thereby to form said binding cord.

2. In a binding machine as claimed in claim 1, means for forming binding bore through papers to be bound, comprising a thin elastic insulating plate in which is embedded a conductive plate adapted to be supplied electric current when contacted by said drill, said conductive plate being electrically connected to a limit switch for reversing an electric motor for raising and lowering said drill.

3. In a binding machine as claimed in claim 1, means for forming binding bore through papers to be bound, comprising a pressure-resistant rubber ring provided between the gear of vertical screw rod for raising and lowering said drill, said vertical screw rod being adapted to be driven by an electric motor, and the lower side of the bearing of said vertical screw rod, and a limit switch for reversing said motor, provided at the lower face of the machine frame confronted by the upper end of said vertical screw rod.

4. In a binding machine as claimed in claim 1, means for feeding the plastic tube which is the material for the binding cord, comprising a starting rod adapted to be lowered in accordance with the downward movement of said pressing member which presses and cramps the stacked papers, said starting rod being further adapted to be lowered further during the subsequent driving of said drill to form said binding bore, and a feed roller adapted to be rotated in accordance with the distance of the further lowering of said starting rod, so as to feed said plastic tube by a length corresponding to said distance.

5. In a binding machine as claimed in claim 1, means for forming a binding cord comprising a vertical guide sleeve having a peripheral cam groove, adapted to move, when rotated, said lower heating mold carrying said plastic tube upwardly, so as to raise said plastic tube toward said upper heating mold positioned above said binding bore, through said binding bore.

* * * * *